United States Patent [19]

Rodriguez

[11] Patent Number: 5,046,675

[45] Date of Patent: Sep. 10, 1991

[54] SYSTEM AND METHOD FOR CUTTING AND SPOOLING A WEB OF PAPER

[76] Inventor: Peter A. Rodriguez, 1785 Selva Marina Dr., Atlantic Beach, Fla. 32233

[21] Appl. No.: 494,418

[22] Filed: Mar. 16, 1990

Related U.S. Application Data

[63] Continuation of Ser. No. 318,127, Feb. 2, 1989, abandoned.

[51] Int. Cl.[5] ..... B65H 19/26; B65H 19/28

[52] U.S. Cl. ..... 242/56 R; 242/65; 242/74

[58] Field of Search ..... 242/56 R, 65, 74

[56] References Cited

U.S. PATENT DOCUMENTS

| | | | |
|---|---|---|---|
| 3,765,615 | 10/1973 | Brink et al. | 242/56 R |
| 4,659,029 | 4/1987 | Rodriguez | 242/56 R |
| 4,711,404 | 12/1987 | Falk | 242/56 R |
| 4,757,950 | 7/1988 | Rodriguez | 242/56 R |
| 4,783,018 | 11/1988 | Rodriguez | 242/56 R |

*Primary Examiner*—John M. Jillions

*Attorney, Agent, or Firm*—Arthur G. Yeager

[57] ABSTRACT

System for cutting a travelling web (20) of paper being wound on a spool (24) and transferring the cut edge to an empty spool (27) to continue the winding; the system including a drive roll (36) for pulling a cutting tape (33) from a supply source (35) and propelling it through a guideway (30) underneath the travelling web (20) of paper from a near end to a far end just short of the nip (29) between the roll (24) of paper being wound and an empty spool (27) to begin winding; an applicator (46–50) for applying a short length of adhesive to the forward end of the tape before it is propelled to the far end; a sensor (51, 52) determines the passage of the forward end of the tape (33) through the guideway (30) toward the far end; another sensor (53, 55) to detect whether a short length of adhesive is present or absent from the forward end of tape; a brake (59) to clamp the tape (33) and prevent the forward end from advancing to the far end of the guideway (30) while the remainder of the tape (33) behind the brake (59) is diverted into a temporary storage area (69) for a large loop of the cutting tape; a cutter (41) to cut the tape to an appropriate length to perform the operation of cutting the web (20) of paper; and a guideway switch (65, 66) to shunt off to a waste collection area a length of cutting tape (33) having no adhesive on its forward end.

20 Claims, 2 Drawing Sheets

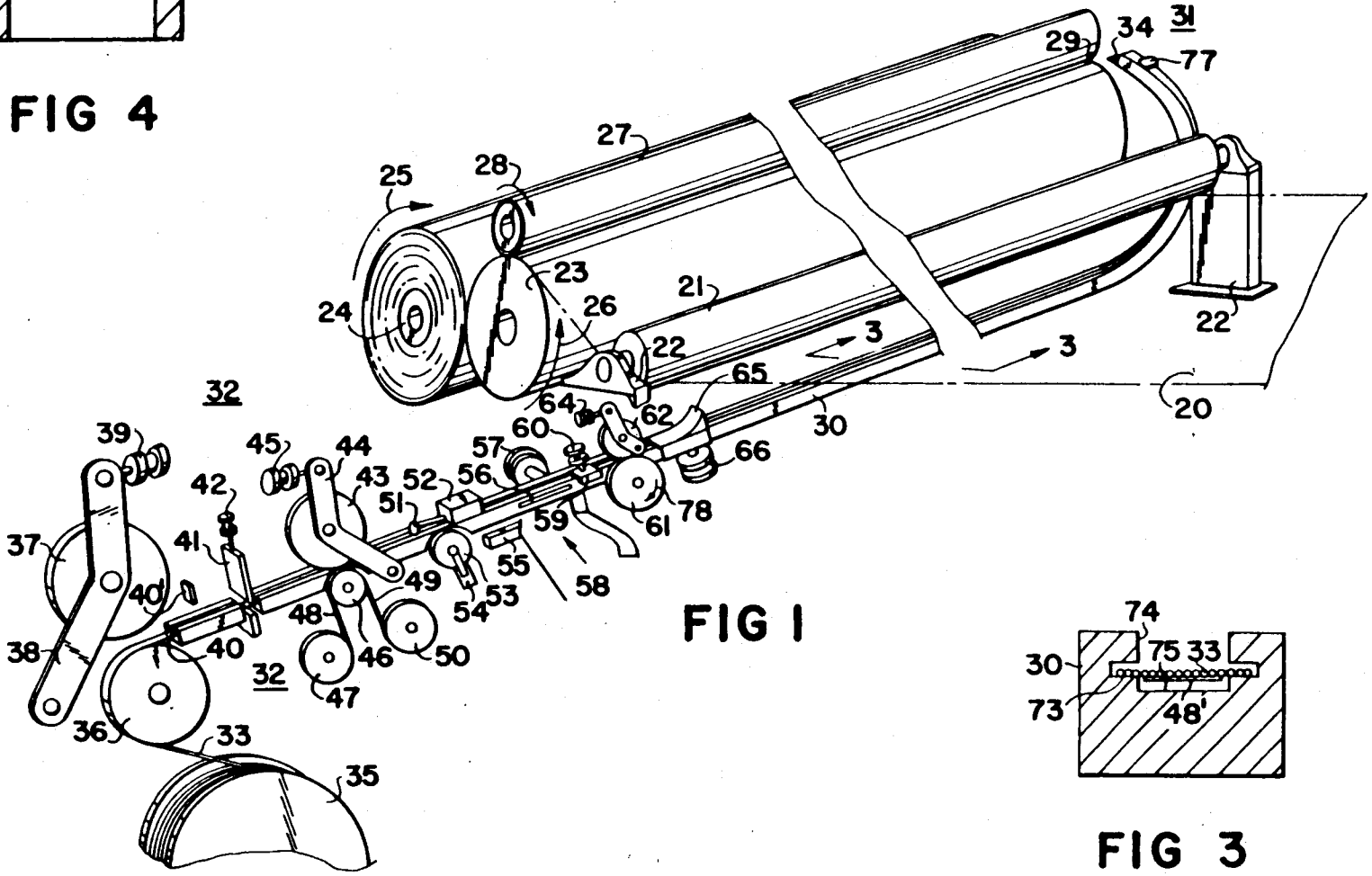
FIG 1
FIG 3
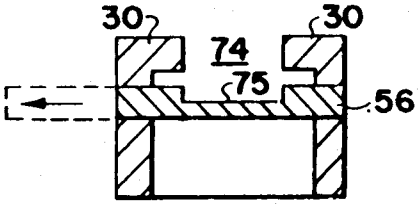
FIG 4

SYSTEM AND METHOD FOR CUTTING AND SPOOLING A WEB OF PAPER

This is a continuation of Ser. No. 318,127 filed Feb. 2, 1989, now abandoned.

BACKGROUND OF THE INVENTION

My three U.S. Pat. Nos. 4,659,029; 4,757,950; and 4,783,018 illustrate the most pertinent prior art to this invention. These patents show how a cutting tape can be passed through a guideway underneath a travelling web of paper, perhaps 10 to 20 feet or more wide and be attached to the far side of an empty spool while the operator remains on the near side of the spool. These patents teach the use of mechanical arms to receive a cut end of the tape with adhesive on the tape, and to push the cut end into contact with the empty spool which winds the tape helically around the spool, cutting the paper web as it does, and wrapping the oncoming web around the empty spool. Processing difficulties have arisen to indicate the need for handling errors, such as the failure to apply a suitable amount of adhesive to the tape, which, in turn, means that the tape does not attach itself properly to the empty spool and, therefore, does not cut the travelling web of paper and transfer it to the empty spool. In the modern high speed plants it is very important that any such errors be handled quickly and efficiently.

It is an object of the present invention to provide an improved system for cutting and spooling travelling webs of paper. It is another object to provide a system which permits the operator of the cutting and spooling steps to perform all of the necessary operations in preparing the cutting tape for its use and sending it to the far side of the empty spool without the necessity of actually moving from his controls on the near side of the spool. Still other objects will become apparent from the more detailed description which follows.

BRIEF SUMMARY OF THE INVENTION

This invention relates to a system and method for cutting with a tape a travelling web of paper being wound on a first spool and for transferring the oncoming web to an empty spool for continued winding by attaching to the far end of an empty spool a cutting tape emerging from a guideway conducting the cutting tape from a supply and processing area adjacent the near end of the empty spool. The guideway extends transversely underneath the travelling web and has a lengthwise slot facing upwardly toward the web. The cutting tape has a forward cut end coated with an adhesive for a short distance along the center portion thereof and leaving the edges free of adhesive to be slidingly supported in the guideway along such edges. The improvements comprise a sensor to detect the presence or absence of a length of adhesive on the cut end; a sensing means to detect the passage of the cut end beyond the means for applying adhesive; a means to divert the cutting tape into a storage space for temporarily housing a long length of the tape; a means for selectively switching the guideway to direct the cutting tape to a waste collection area or toward the far end of the guideway; and a final propelling means for advancing the cut end from adjacent the far end to contact with the empty spool; the means for cutting the tape is located between the supply source and the adhesive application means; and a brake means selectively clamps the tape to the guideway so that a loop of tape is formed.

In some preferred embodiments of the invention the system provides means for physically removing a portion of the guideway so as to permit loop formation while being engaged in the guideway at the forward end of the loop. The preferred adhesive applicator includes a release tape to which double-sided pressure sensitive adhesive tape is attached and a roller means for attaching a portion of the adhesive tape to the forward end of the cutting tape. Another specific embodiment includes an operational connection between the sensor to detect the presence or absence of adhesive tape on the cutting tape, and a switch to divert to a waste collection area any tape that does not contain the adhesive tape attached thereto. The system also prefers the far end of the guideway to end closely adjacent to the empty spool and to include a propelling means adjacent the near end of the guideway for extending the forward end of the tape to the nip of the empty spool without the assistance of a mechanical arm.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 1 is a schematic view in perspective of the system of this invention;

FIG. 3 is a cross sectional view taken at 3—3 of FIG. 1 or FIG. 2; and FIG. 4 is a cross sectional view taken at 4—4 of FIG. 2.

DETAILED DESCRIPTION OF THE INVENTION

Figure 2:
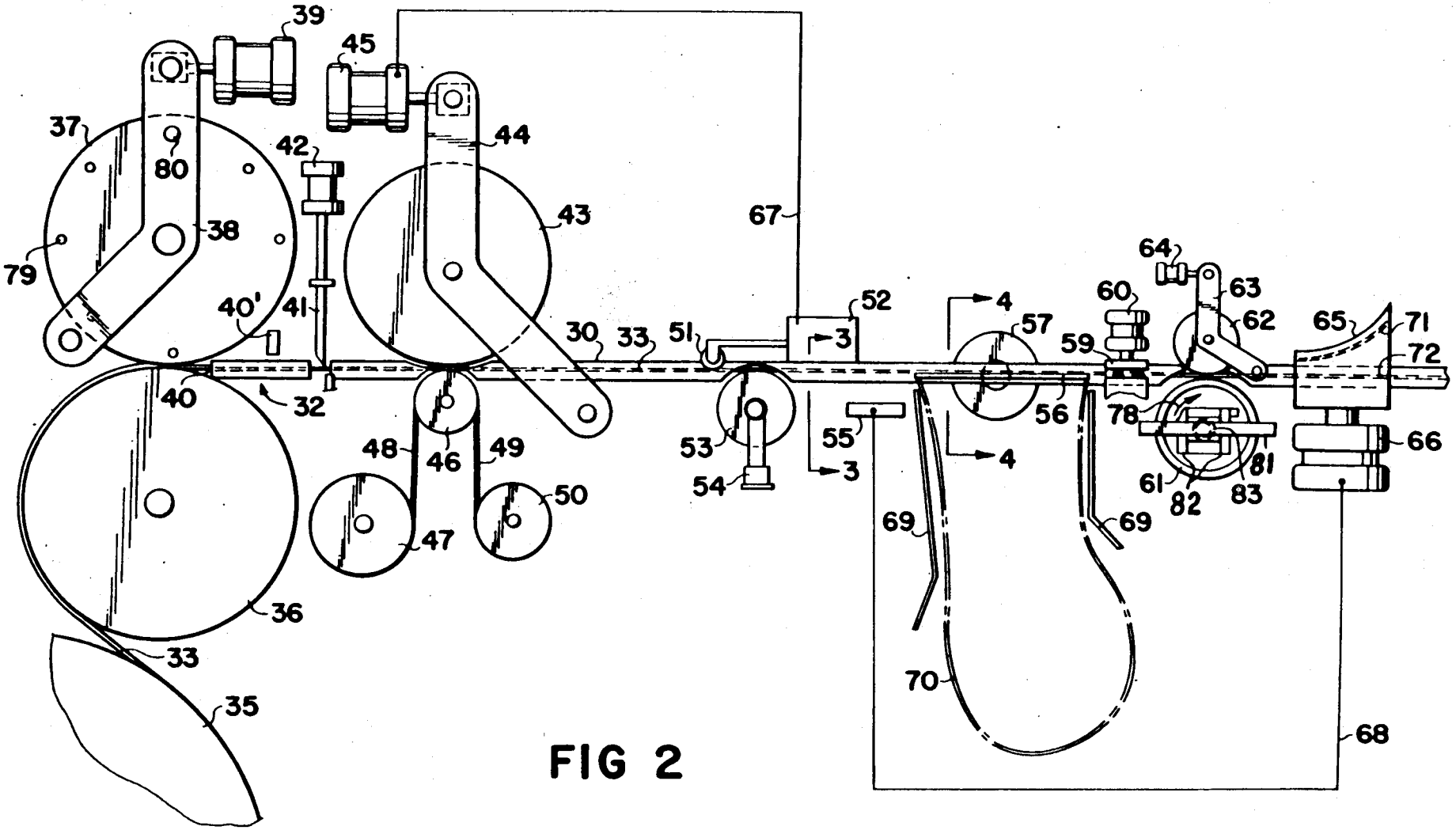
FIG. 2 is an enlarged schematic view in elevation of the control mechanism of the system of the invention.

The general features of this invention are best seen and understood by reference to FIG. 1 which shows the general type of equipment employed in a paper manufacturing plant to wind up the manufactured paper on rolls for storage and use elsewhere. A continuous web of paper 20 travels at a relatively rapid rate of speed to a combination of spools upon which the paper is rolled. Paper web 20 advances toward tension roll 21 mounted in journals on supports 22, leading web 20 over driving roll 23 and winding about spool 24 turning in the direction of arrow 25. Driving roll 23 turns in the direction of arrow 26 and is pressed against the paper roll on spool 24 causing it to rotate in the indicated direction. When spool 24 has been filled to the desired capacity with paper from web 20, it is necessary to cut web 20 laterally, transfer the cut edge to an empty spool 27, and start the web winding on that spool in the direction of arrow 28 to eventually produce another filled spool, such as spool 24. Empty spool 27 is positioned vertically above the location shown in FIG. 1 until it is ready to accept paper from web 20 and begin winding it up. Spool 27, which may or may not be separately rotated as known in the art, is lowered until it contacts driving roll 23 and rotates with it, as shown in FIG. 1. Paper web 20 is then cut and the leading edge of web 20 is wrapped around an empty spool so that it may continue to wind up web 20 until that spool is ready to be replaced with still another empty spool. In accordance with this invention, as well as those of my previous patents mentioned above, the web 20 is cut by introducing a cutting tape 33 at its forward end 34 into the nip 29 of empty roll 27 and driving roll 23 at the far end of the rolls causing tape 33 to wrap itself helically around spool 27 while cutting web 20 transversely in front of spool 27 and automatically carrying web 20 onto spool 27 to continue the winding of web 20 thereon. The cutting tape 33 is conducted from near end 32 to far end 31 in a guideway 30 passing underneath travelling web 20. In this invention forward end 34 of tape 33 is conducted to adjacent the exit from guideway 30 at far end 31 and stops there to await the appropriate time to be moved forward to enter nip 29. The final movement of forward end 34 into nip 29 may be automatic depending on the movement of some part of the system as, for example, the primary arms of the spools actuating a limit switch, or it may be accomplished by the operator actuating a switch. It is an important feature of this invention to have all the controls, operations and checkpoints on the near end 32 of rolls 21, 23 and spools 24, 27 so the operator will not be forced to go several feet under or over the travelling web 20 of paper to cause forward end 34 to be introduced into nip 29 to cause the paper web 20 to be cut and the web to start winding onto spool 27.

The principal features of this invention are the controls, sensing devices, and operational devices on the near side 32 of the spools and the web of paper 20. These are shown in their relationship to each other in both of FIGS. 1 and 2. Cutting tape 33, as described in my previous patents is a plurality of parallel strands of twisted repulpable paper fibers and is stored on a large supply spool 35, from which it is led into the entrance 40 of guideway 30 and conducted in an upside-down T-slot as shown in FIG. 3 where the cross bar 73 of the T is the conduit for cutting tape 33 and the leg 74 of the T is an opening extending lengthwise of guideway 30. A shallow recess 75 along the bottom of cross bar 73 is incorporated in the guideway so that the corresponding portion of cutting tape 33 above that recess may be coated with adhesive and not be in contact with guideway 30. It may be seen that cutting tape 30 is supported in its movement by the side edges of the tape in the side edges of cross bar portion 73. Tape 33 is sufficiently stiff to bridge this recess 75 and provide no frictional drag problems as tape 33 moves through guideway 30.

Tape 33 from supply roll 35 passes between rolls 36 and 37 and is propelled by driving roll 36 having tape 33 pressed there against by pressure roll 37. Pressure is applied by means of lever 38 to which is attached a pneumatic cylinder device 39 causing roll 37 to press against roll 36. Roll 36 is rotated by means not shown here, such as a shaft driven by a pulley and a belt from a motor. Tape 33 enters guideway 30 at entrance 40 into the T-slot described above and its presence is sensed by a photocell sensor 40'. If no tape thereat, the operator changes the supply roll and/or starts it between rolls 36 and 37. Tape 33 is propelled all the way across to far side 31 to the end of guideway 30 such that cut end 34 is about 3 inches short of nip 29. Sensor 77 notes that cut end 34 has passed by, and signals brake cylinder 60 and loop gate cylinder 57 to function. Alternatively sensor 77 may be omitted and pressure roll 37 controlled so as to rotate a selected number of revolutions and portions of revolutions, as measured by equidistant pick-up points 79 on roll 37, passing sensor 80, so as to propel cut end 34 to exactly the position desired short of nip 29. Brake pads 59 which oppose each other from both sides of tape 33 are squeezed together by pneumatic cylinder means 60 to stop any further movement of tape 33 toward far side 31. Pneumatic cylinder 57 actuated is to cause section 56 of the T-slot in guideway 30 to be withdrawn leaving an unobstructed opening 58 into the temporary storage space below. This storage space is defined by guide walls 69 and permits a large loop 70 of tape 33 to hang down as seen in FIG. 2. Driving roll 36 continues to propel tape 33 into entrance 40 causing loop 70 to form. Pressure roll 37 is calibrated to turn a given number of revolutions so as to propel a selected length of tape 33 and then to stop automatically. When driving roll 36 stops, guillotine cutter 41 is actuated by pneumatic cylinder 42 to cut through tape 33 providing thereby a selected length of tape 33 from cutter 41 to cut end 34 for use in cutting paper web 20 at the appropriate time, which may be selected by the operator, or may be automatically set by a switch actuated by the movement of empty spool 27 into place for receiving web 20. When the operator is ready, cylinder 64 is activated moving lever 63 to cause press roll 62 to press tape 33 against propelling roll 61 to rotate a selected amount. A preferred procedure is to employ a rack 81 and pinion 83 combination in which a selected linear movement of a rack 81 through support bearing 82 causes pinion gear 83 to turn and rotate roller 61 in the direction of arrow 78 to push cut end 34 forward until it is caught in nip 29. As soon as the rotation of roll 61 is completed, brake pads 59 are pressed together to provide resistance to the movement of tape 33 in guideway 30. Tape 33 is helically wrapped around empty spool 27 and pulled taut because of the resistance provided by brake 59. This causes tape 33 to cut paper web 20 and to guide the cut edge onto spool 27 for winding up.

When the paper web 20 is safely and securely attached to spool 27 and being wound thereon, the operator causes a new cycle of operations to start that will result in having another length of tape 30 ready to be advanced into nip 29 to cut web 20 and start a new spool 27. The operations on the leading cut end 34 begin as it passes adhesive applicator roll 46 where single length, e.g., 3–4 inches, of double-sided pressure-sensitive adhesive tape on a supply tape 48 from supply roll 47 passes under tape 33 and is pressed against tape 33 by press roll 43, pushed downwardly by lever 44 operated by pneumatic cylinder means 45. The length of double sided adhesive tape 48 is adhered to tape 33 while release liner 49 is peeled away from the adhesive tape and wound onto windup roll 50. As cut end 34 moves forward it is sensed by roller 51 which causes a signal to be sent from sensor housing 52 to pneumatic cylinder 45 to cause press roll 43 to lift slightly from tape 33 so as not to apply any further pressure to tape 33 at applicator roll 46 and thereby to attach only one length of adhesive tape to cutting tape 30. Tape cut end 34 then passes over sensor roller 53 which has a metal surface or other surface which tends to cling to the adhesive of the pressure sensitive tape on the bottom side of tape 33 applied at roll 46. The passage of the length of double-sided adhesive tape causes sensor roll 53 to rotate and thereby to swing arm 54 in a circle that passes near magnetic switch 55. This action causes a signal to be sent to pneumatic switch 66 operating guideway track switch 65 to keep it open for tape 33 to pass straight through portion 72 toward far side 31. If for any reason the cut end 34 does not have a length of adhesive tape thereon causing sensor roll not to rotate, no signal is sent to pneumatic switch 66 and guideway track switch 65 is thereby positioned to cause tape 33 to extend via portion 71 outwardly about 10 inches and to await the operator's option to apply a section of adhesive tape by hand, or to guide tape 33 to a waste collection area. If tape cut end 34 has no adhesive on it, it will not catch onto empty spool 27 and will not cut paper web 20. If all is well, with an adhesive tape portion on cut end 34, tape 33 will proceed to far side 31 to the end of guideway 30, brake pads 59 will be applied to stop the movement of tape 33, track section 56 will be removed, loop 70 will be formed and cutter 41 will cut tape 33 to complete the cycle.

It should be clear that many of the component parts of the system of FIG. 2 can be replaced by other items than those mentioned above. Pneumatic cylinders 39, 42, 45, 57, 60, 64 and 66 could be hydraulic cylinders, solenoids, or other linear movement devices. Adhesive application system of rolls 43, 46, 47 and 50 could be replaced by adhesive spray systems, or adhesive roll-on systems as described in my U.S. Pat. No. 4,783,018. Sensing devices 51, 52, 53, 54 and 55 could be replaced by light beam or X-ray beam interrupting systems or other similar detectors known in the art. The operation of levers 38, 43, and 63 could be spring biased so as to assume one position automatically and to be moved by the corresponding pneumatic cylinders in only one direction rather than two. Similarly track switch 65 could be spring biased to be in one position automatically, and be moved to the other position only when signalled to do so.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A system for cutting with a tape a travelling web of paper being wound on a first spool and for transferring the web to an empty spool for continued winding by attaching to the far end of an empty spool a cutting tape emerging from a guideway, the tape being fed from a supply and processing area adjacent the near end of the empty spool, the guideway extending transversely beneath the web and having a lengthwise slot facing generally upwardly toward the web or spools, the tape having a forward cut end portion coated with an adhesive for a short distance along the center portion thereof and leaving the edges free of adhesive, the tape being slidingly supported in the guideway along the edges that are free of adhesive, a propelling means for feeding the forward cut end portion of an endless supply of tape through the guideway and through an applicator means for applying to the cut end portion adhesive along the central portion of the tape while leaving the edges of the tape free of adhesive, means for cutting the tape forwardly of said endless supply of tape, and means for advancing said cut end portion from adjacent said far end to contact with said empty spool, the improvement which comprises a sensor adjacent said near end to detect the presence of said adhesive on said cut end portion, and means adjacent said near end for selectively directing said tape toward said far end of the guideway when said sensor detects the presence of said adhesive on said cut end portion.

2. The system of claim 1 wherein said means adjacent said near end for selectively directing said tape also selectively directs same to a waste collection area when said sensor fails to detect the presence of said adhesive on said cut end portion, said sensor is operatively connected to said means for selectively directing said tape so as to direct to the waste collection area tape having an absence or an insufficient amount of adhesive, and correspondingly, to direct to said far end tape having a presence of a sufficient amount of adhesive.

3. The system of claim 1 wherein said applicator means for applying to said cut end portion adhesive includes applying a short length of double-sided adhesive to said cut end portion, said sensor being operatively connected to said means adjacent said near end for selectively directing said tape so as to direct to a waste collection area tape having an absence or an insufficient length of double-sided adhesive or to permit an operator to supply adhesive thereto before directing to said far end such tape.

4. The system of claim 1 wherein said sensor includes a stationary magnetic operable switch means for detecting the passage of a magnetic member and a roller adapted to be freely rotated about its axis by the passage of said tape with a length of adhesive thereon by frictional contact between said adhesive and the surface of said roller, said roller including a magnetic member adapted to rotate with said roller to actuate said switch means when said roller rotates at least more than one-half revolution to assure the presence of a sufficient length of adhesive.

5. The system of claim 1 further comprises a brake means to selectively clamp said cutting tape, a far end sensor to detect the passage of said cut end portion at said far end of said guideway, said far end sensor being operatively connected to said brake means to cause said brake means to stop further forward movement of said cutting tape until said means for advancing is operated to move said tape cut end portion into its contact and attachment via said adhesive thereon with said empty spool.

6. The system of claim 1 further comprising means to divert a trailing portion of said cutting tape attached to said cut end portion into a storage space to form a loop prior to cutting said tape by said means for cutting, said means to divert including means to slideably remove a section of said guideway so as to allow said cutting tape advancing toward said section to form said loop of cutting tape hanging downwardly from said guideway while remaining supported by said guideway ahead of and behind said section.

7. The system of claim 1 wherein said adhesive tape is applied to said cutting tape by pressing against said cutting tape a release tape having a plurality of spaced lengths of adhesive tape adhered to a release tape which readily is releasable from said adhesive tape.

8. The system of claim 1 further comprising sensing means adjacent said near end to detect the passage of said cut end portion of said cutting tape beyond said means for applying adhesive.

9. The system of claim 8 wherein said sensing means to detect said cut end is operatively connected to said means to apply adhesive so as to apply only one length of adhesive tape to said cut end and to position said means for application to the next succeeding length of cutting tape.

10. The system of claim 1 further comprising brake means to selectively clamp said tape, said brake means being applied immediately after advancing said cut end of said tape to contact with said empty spool, so as to apply resistance to said cutting tape causing it to pull taut and thereby cut said web of paper.

11. The system of claim 1 wherein said means for advancing includes a pair of spaced driving rollers, one of said driving rollers being disposed between said supply of tape and said applicator means for unwinding said tape from said supply and pushing said tape through said guideway to receive adhesive, the other of said driving rollers being spaced forward of said applicator to push said cutting tape into contact with said empty spool.

12. The system of claim 11 wherein said other driving roller is forward of said means for cutting the tape.

13. The system of claim 11 further comprising means for forming a large loop adjacent the trailing end of said cutting tape.

14. The system of claim 13 wherein means for forming a large loop is located between said cutting means and said other driving roller.

15. The system of claim 13 wherein said means for forming a large loop is located between said applicator and said other driving roller.

16. The system of claim 1 further comprising means for forming a loop adjacent the trailing portion of said cutting tape prior to feeding said cut end portion into contact with said empty spool, said loop being formed prior to cutting said tape by said means for cutting.

17. The system of claim 16 further comprising selective means for slideably removing a section of said guideway for allowing said loop to be formed beneath said guideway while remaining supported by said guideway forward and rearwardly of said section.

18. The system of claim 16 wherein said means for advancing includes a pair of spaced drive rollers selectively engaged with said cutting tape, one said drive roller withdrawing said cutting tape from said supply of tape and another said drive roller being spaced forwardly of said means for cutting and pushing said cutting tape into contact with said empty spool.

19. A method of preparing a tape to be used in cutting a travelling web of paper being wound on a spool and transferring the web to an empty spool for continued winding, the method including the steps of moving sufficient tape from a supply roll into a guideway extending from the near side to the far side of the web; applying adhesive adjacent the near side to the central portion of the underside of the tape adjacent its far end so that the tape may be supported along its side edges by the guideway during its movement after the adhesive is applied; the improvement comprising the steps of a. sensing the tape after the adhesive is applied to the tape to assure the proper application thereof; and b. pushing the tape from a position adjacent the near side to cause the tape and adhesive to engage an empty spool so that the cut web of paper is transferred and wound onto the empty spool.

20. The method of claim 19 further comprising the step of:

c. forming a loop of the tape adjacent its near end prior to cutting the tape at its near end by selectively removing a supporting portion of the guideway to permit loop formation therebelow.

* * * * *